US007003918B2

(12) United States Patent
Williams

(10) Patent No.: US 7,003,918 B2
(45) Date of Patent: Feb. 28, 2006

(54) BUILDING FOUNDATION WITH UNIQUE SLAB AND WALL ASSEMBLY, EXTERNAL SUMP, AND VOID RETENTION DAM

(76) Inventor: Jonathan P. Williams, 3201 Mariner La., Longmont, CO (US) 80503

( * ) Notice: Subject to any disclaimer, the term of this patent is extended or adjusted under 35 U.S.C. 154(b) by 138 days.

(21) Appl. No.: 10/659,872

(22) Filed: Sep. 11, 2003

(65) Prior Publication Data

US 2004/0050001 A1 Mar. 18, 2004

Related U.S. Application Data

(60) Provisional application No. 60/409,782, filed on Sep. 11, 2002.

(51) Int. Cl.
*E02D 27/00* (2006.01)

(52) U.S. Cl. ..... 52/169.5; 52/264; 52/169.6; 52/169.14

(58) Field of Classification Search ..... 52/169.9, 52/169.5, 169.6, 272, 274, 263, 264, 250, 52/251, 414, 169.14
See application file for complete search history.

(56) References Cited

U.S. PATENT DOCUMENTS

| | | | | |
|---|---|---|---|---|
| 1,840,304 A | * | 1/1932 | Branson | 52/337 |
| 2,076,267 A | * | 4/1937 | Edwards | 52/250 |
| 4,298,294 A | * | 11/1981 | Zimmerman | 405/37 |
| 4,507,901 A | | 4/1985 | Carroll | |
| 4,631,872 A | * | 12/1986 | Daroga | 52/1 |
| 4,894,967 A | * | 1/1990 | Morton | 52/334 |
| 4,907,386 A | * | 3/1990 | Ekroth | 52/169.14 |
| 5,259,157 A | | 11/1993 | Ault | |
| 5,359,816 A | * | 11/1994 | Iacouides | 52/274 |
| 5,560,150 A | | 10/1996 | Pearson | |
| 5,564,235 A | | 10/1996 | Butler | |
| 5,615,525 A | * | 4/1997 | Kenworthy | 52/169.5 |
| 5,729,940 A | | 3/1998 | Bullivant | |
| 5,771,518 A | | 6/1998 | Roberts | |
| 5,782,049 A | | 7/1998 | Gates et al. | |
| 5,797,226 A | | 8/1998 | MacKarvich | |
| 5,934,036 A | * | 8/1999 | Gallagher, Jr. | 52/323 |
| 6,131,350 A | | 10/2000 | Sanders | |
| 6,237,291 B1 | | 5/2001 | Elwart | |
| 6,289,638 B1 | | 9/2001 | Vasseur | |
| 6,314,693 B1 | | 11/2001 | Sanders | |
| 6,415,581 B1 | * | 7/2002 | Shipman et al. | 52/798.1 |

FOREIGN PATENT DOCUMENTS

| | | | | |
|---|---|---|---|---|
| AU | 8824964 | * | 5/1989 | 52/263 |

* cited by examiner

*Primary Examiner*—Naoko Slack
(74) *Attorney, Agent, or Firm*—Kent A. Lembke; Hogan & Hartson LLP.

(57) ABSTRACT

A structural foundation assembly for use with expansive and other soils. The foundation includes slab and wall assembly in which foundation walls are poured on an upper surface of a previously poured slab such that the slab supports the walls. The slab is poured in a slab form supported upon a center, elongate support beam that is supported by piers. The height of the piers and beam provide a void between the slab and soil to allow the soil to expand and contract. The wall is attached to the slab with angled connector members in the slab. The foundation includes a dam that has planar members positioned about the periphery of the slab contacting the soil and the slab to block soil from entering the void space. A sump pit is provided exterior to the slab and wall assembly with access provided by a window well in the foundation.

17 Claims, 4 Drawing Sheets

BUILDING FOUNDATION WITH UNIQUE SLAB AND WALL ASSEMBLY, EXTERNAL SUMP, AND VOID RETENTION DAM

CROSS REFERENCE TO RELATED APPLICATIONS

This application claims the benefit of U.S. Provisional Application No. 60/409,782, filed Sep. 11, 2002, which is incorporated by reference herein in its entirety.

BACKGROUND OF THE INVENTION

1. Field of the Invention

The present invention relates generally to concrete building foundations, and, more particularly, to a building foundation for use with expansive soils that includes a slab and wall assembly in which the walls are supported by the slab and/or an external sump pit for which access is provided in a window well or other access point external to the foundation walls and/or includes a dam about the external, lower portion of the slab and wall assembly for maintaining a void space under the walls and the slab.

2. Relevant Background

Commercial and residential buildings are often built on foundations comprising vertical perimeter walls of poured concrete. Since the vertical foundation walls are structural members that support the building, they are usually several feet in depth and function as beams bridging between footers or piers resting on bedrock or stable soil. It is common practice in such buildings to provide a basement, or ground floor, wherein at least a portion of the basement walls include the vertical foundation walls and wherein the basement floor is a poured concrete slab resting on the soil enclosed by the foundation walls. Typically, the foundation is constructed by first excavating a pit for the basement and for the foundation footers. Then, forms are erected around the periphery of the pit and concrete for the foundation walls is poured into the forms. The floors are next formed by pouring concrete onto a form supported by the soil and/or by the side walls. In other words, the slab or flooring is typically mechanically attached at one end to an inner side of the foundation walls.

A major problem with conventional construction in certain soil and climate conditions is that the slab floor is unstable due to movement of the underlying soil. Expansive soils are prevalent in many areas of the United States and other countries. These expansive soils can expand and contract considerably as a result of cyclical changes in moisture content or as a result of freezing and thawing cycles. The soil expansion and contraction problem can be especially severe when the floor is simply a slab of concrete poured onto the surface of the soil that forms the floor of the excavation pit. For example, certain dense clay soils tend to dry out after excavation and then later absorb water and swell. This swelling or expansion causes the slab to move relative to the foundation walls which can generate large forces that are sufficient to crack or break the slab. In general, because the foundation walls must support the building, they are supported by piers or pads on solid ground or bedrock or piers or pads on footings and therefore are very stable. However, the movement of the slab mechanically attached to the side of the foundation wall can readily damage the relatively rigid walls.

A variety of techniques have been implemented to control the effects of expansive soils on concrete foundations and structural slabs or floors. Generally, each of these techniques attempts to separate the foundation walls and structural slabs or flooring from the heaving soils or to at least absorb some of the expansive forces created by the moving soil. To address the problematic soils, such as Bentonite clay, builders have employed techniques such as raised, suspended, or free-spanning floors. Unfortunately, these techniques have proven to be costly, to increase the complexity of fabricating concrete foundations and flooring, to cause long-term structural or safety problems, and to reduce spacing between the floor and ceiling. Additionally, to obtain a particular wall height, a taller or bigger side wall is required to accommodate for the thickness of the floor slab and/or for void space provided under the floor slab. This requires addition material costs for concrete and labor costs for excavating and fabricating the foundation walls.

A common technique of protecting the foundation and slab from the expanding soil is to create a void space under the concrete slab or floor. To create the void, cardboard forms or other degradable material forms and/or removable forms are positioned under the form or pan used during pouring of the foundation walls and floor. With time, the material of the void form begins to deteriorate creating a void in which the soil can expand without moving the wall or floor. However, the degradation of the forms typically is accompanied by mold growth and the release of associated toxins, which can result in safety issues within the structure above the concrete foundation. Additionally, jobsite delays and inclement weather during initial construction can result in premature degradation of the cardboard void form and loss of the strength needed to support the curing concrete wall and floor.

Other difficulties that face the designer of a foundation are how to maintain the integrity of the void space underneath the walls and floor slab and how to maintain the strength of the foundation. When a void space is provided under a foundation wall and/or under a concrete slab attached to the side of the wall, excavated soil has a tendency to fall or migrate horizontally from excavated earthen walls and backfill into the void. This can lead to expansive soils being in contact, at least locally, with the foundation wall and/or floor, which can result in heaving or at least additional stresses in the foundation. The strength of the floor is often deteriorated by providing openings for utilities, such as plumbing and a sump pit used for draining collected groundwater from the area around the foundation. For example, sump pits are often placed as part of forming the slab for the floor or foundation slab, which causes a reduction in the slab strength in the vicinity of the sump pit that can result in cracking or failure of the slab. Additionally, the sump pit may itself be in contact with expansive soil that applies force against the pit and the pit walls in turn apply a force against the adjoining portion of the foundation slab. If provided simply as an opening in the slab, the sump pit may provide a path for molds and the like to enter the space above the slab, i.e., the commercial or residential building.

Hence, there remains a need for a foundation design that accounts for expansive soil but that also provides a relatively inexpensive method for manufacturing the foundation walls and flooring slab. In such a foundation design, preferably a void is provided under the flooring slab to control stresses caused by expanding and contracting soil and even with the void the strength of the foundation walls and slab are maintained. Further, it is preferable that the foundation design be such That standard (e.g., not taller) walls may be utilized to obtain a desired floor to ceiling height.

SUMMARY OF THE INVENTION

The present invention addresses the above problems by providing a foundation with slab and wall assembly in which the foundation wall is supported by the top of the slab rather than the slab being supported by the walls. This arrangement eliminates the need for "taller" foundation walls, as was the case with prior foundation walls in foundations with underlying void spaces. Additionally, the mating of the slab and the wall is relatively airtight, which reduces the chances of mold or other toxins passing into the interior spaces of the foundation. In some embodiments of the foundation, a sump pit is provided outside the building envelope by positioning the sump pit external to the foundation walls. In one embodiment, the sump pit is located at the bottom of a window well to provide ready access to the sump pit and any contained sump pump. The slab and wall assembly is raised above the bottom of the window well such that the void space beneath the foundation can be accessed from the window well.

According to another aspect of the invention, a dam (e.g., a void retention dam) is placed about the periphery of the foundation to block soil from backfilling into the void space beneath the slab and wall assembly. The dam is typically formed of waterproof or water resistant material, such as polystyrene, to limit degradation caused by moisture in the soil and in the window well. The dam is preferably anchored into the soil although it may be attached to the slab and wall assembly, and at least within the window well, the dam is preferably removable to allow access to the void space.

DETAILED DESCRIPTION OF THE PREFERRED EMBODIMENTS

Figure 1:
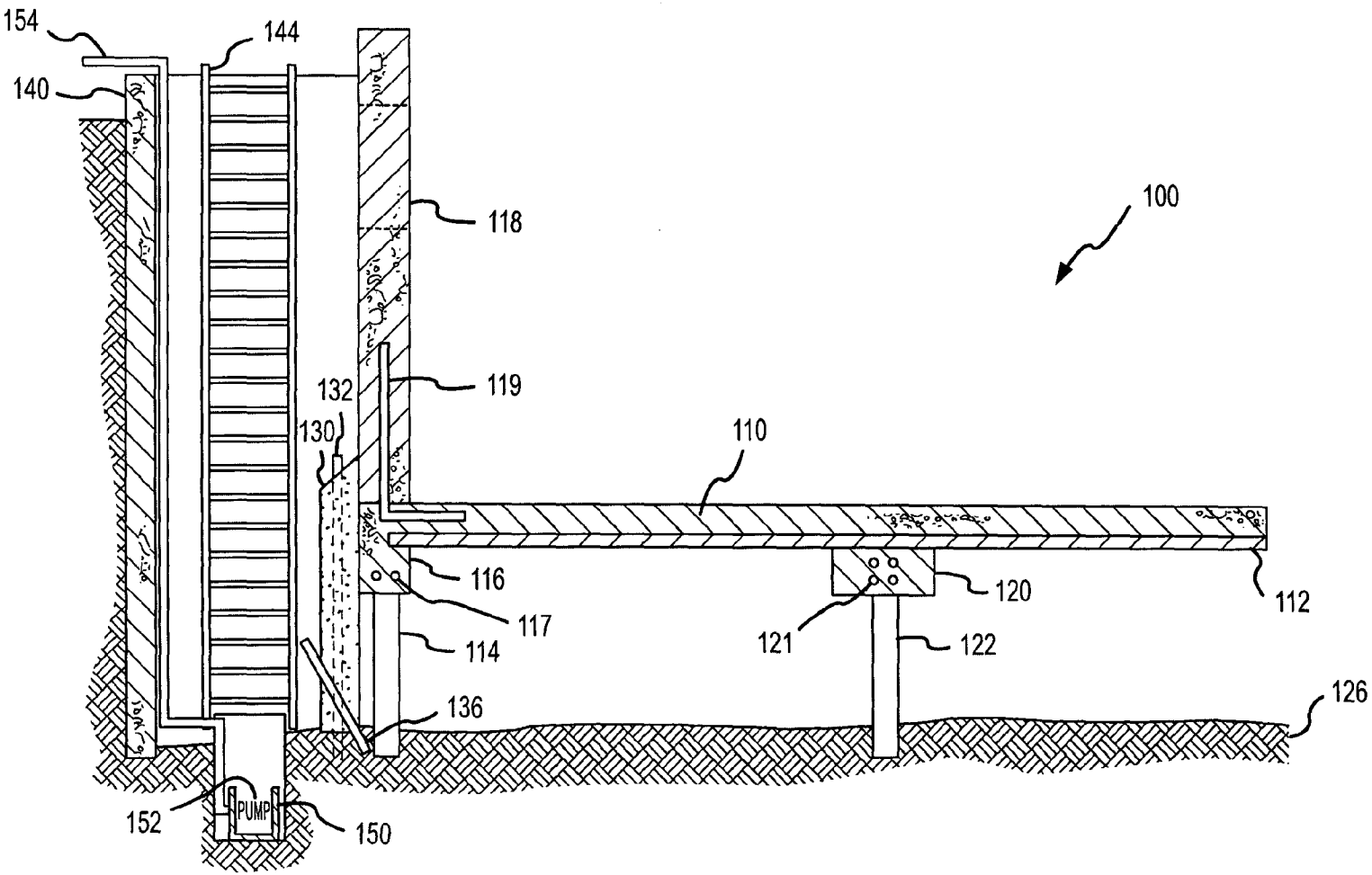
FIG. 1 a partial sectional view of a foundation according to the present invention illustrating a slab and wall assembly in which a foundation wall is supported by a flooring slab and also illustrating an external sump pit and a void retention dam.

Briefly, FIG. 1 illustrates one embodiment of a foundation 100 according to the present invention that is useful for providing a void space between potentially expansive soils 126 and foundation structural components. As shown, a slab and wall assembly is provided by a slab 110 that is poured first and then used to support later poured or formed foundation walls 118. The seal between the wall 118 and slab 110 is such that water or moisture, off-gases, and/or other toxins in the soil 126 (or any biodegradable materials in the void space beneath the slab 110) cannot readily pass to the interior space defined by the slab 110 and walls 118. Both the slab 110 and walls 118 are supported on piers 114, 122 and outer and inner support columns or beams 116, 120, respectfully, to provide a void beneath the slab 110 and form or pan 112.

Additionally, a dam 130 is provided about the periphery of the foundation slab 110 (and wall 118) such that soil 126 is blocked from seeping or backfilling into the void space beneath the pan 112 and slab 110. Further, the foundation 100 includes a sump pit 150 positioned exterior to the building envelope defined by the slab 110 and walls 118 such that the slab's strength is retained and any water or moisture, off-gases, and/or toxins that often pass through sump pits are not passed into the building. By locating the sump pit 150 in the window well 140, access is provided to the sump pit 150 and also to the space beneath the slab 110. In this regard, the dam 130 (at least in the window well 140) is preferably movable after any placement hardware is removed, e.g., the vertical and angular pins or stakes 132, 136, respectfully.

More particularly, the foundation of FIG. 1 includes a slab and wall assembly that differs from conventional slab and wall arrangements in that the slab is used to support the wall rather than the wall supporting the slab. As shown, the foundation 100 includes a slab 110 with an adjoined or monolithic end beam 116. The end beam (or wall-support beam) 116 is supported on piers 114 that, although not shown, are typically spaced apart piers that are separately formed of poured concrete and extend into the ground 126 a distance. The number, shape and size of the piers 114 may vary to practice the invention but are used to support the end beams 116 as the columns are hardening and after the placement of the walls 118. Bars 117 are optionally provided for additional strength in the end beams 116. The end beams 116 are typically rectangular but a square or other shaped beam and/or column may be utilized. Generally, the end beams 116 have a width that is substantially equivalent to the thickness of the foundation walls 118 but smaller or greater widths may be utilized in some cases. Further, although not shown, some embodiments of the foundation 100 may omit the end beams 116 with structural support for the walls 118 being provided by the slab 110 that in turn is supported by the piers 114. The piers 114 in some cases may be replaced by pads and/or other known support elements.

The slab 110 is formed by pouring concrete into pan or form 112, which in turn is supported by an interior support beam 120. The support beam 120 is typically formed prior to forming of the slab 110 with bars or other strengtheners 121 and is formed upon pier 122 such that the piers (or pads or other structural supports) 122 support the beam 120. The piers 122 (and pier 114) are provided to provide structural support and also to provide a void between the expansive soil 126 and the bottom of the slab pan 112 and beams 116, 120. For a more complete discussion of the use of an interior beam 120 and creation of a void space see FIGS. 2–4 and corresponding description. The pan 112 may take a number of shapes but typically is a metallic or non-metallic sheet without or with ridges (see, for example, the pan 12 shown in FIG. 4 for a useful configuration of a pan). The pan 112 functions to support the slab 110 when it is first poured. The pan 112 is shown to extend into the end beam 116 so as to further provide at least some additional (e.g., in addition to that would be obtained by concurrently pouring and forming the beam 116 and slab 110) structural support and integrity between the slab 110 and beam 116.

According to an important aspect of the invention, the foundation walls 118 are supported by the slab 110. Typically, the slab 110 is poured first and allowed to harden and then the walls 118 are formed on top of the slab 110, i.e., at the outer edges of the slab sides. Preferably, the wall 118 is mechanically joined to the slab 110 to increase the structural integrity of the foundation 100. In some cases, this is achieved by mechanically fastening, such as with metallic braces, rebar, or angle iron fastened to both the slab 110 and walls 118. More typically, connectors, such as connectors 119, are positioned within the slab 110 during the formation of the slab 110. Then, the walls 118 are formed or poured upon the connectors 119 so as to bind the walls 118 to the connector 119 and slab 110. The connectors 119 may take a number of forms to practice the invention such as bent rods spaced apart about the edge of the slab 110 or angle iron and the like that extends into the slab 110 and upward into the walls 118. The thickness of the slab 110 and width or thickness of the walls 118 may vary and often are standard dimensions defined by building codes to provide predetermined structural strength.

According to another aspect of the invention, the foundation 100 is adapted for blocking soil 126 from excavated side walls from backfilling or falling into the void under the slab 110 and walls 118. In this regard, the foundation 100 includes a dam or barrier 130 that is positioned on top of the soil 126 adjacent the void beneath the walls 118 and slab 110 and so as to extend about the periphery of the slab 110 (or on all sides of the slab 110). The dam 130 is selected to have a height that is larger than at least the void height below the end beam 116 and more typically larger than the void height below the pan 112 and/or slab 110. In this manner, a portion of the dam 130 extends above the void space to effective block access to the void space. The dam 130 is positioned to contact or abut the end beam 116 (and, in some embodiments, a portion of the walls 118). The dam 130 may be anchored in position adjacent the slab 110 by use of vertical anchors, pins, or stakes 132 that extend through the dam 130 into the soil 126 and by angled anchors, pins, or stakes 136 that extend at an angle through the dam 130 into the soil 126. The dam 130 is typically fabricated from a plurality of sections of water-resistant or water-proof material, such as a plastic (e.g., polystyrene and the like), that resist degradation over long periods of exposure to water and other conditions associated with positioning in or adjacent to soil 126.

The foundation 100 is further adapted for enhanced strength and for better limiting off-gases, water, or toxins flowing through the slab 110 and walls 118 assembly by the inclusion of an exterior (or outside-of-the-envelope) sump pit 150. As shown, the foundation 100 includes a sump pit 150 that is positioned outside the envelope or profile of the slab 110 and walls 118. Generally, as part of forming a foundation (at least in areas with groundwater concerns), drainage pipe (not shown) is installed below or adjacent a slab or wall on a layer of crushed rock. The drainage pipe is then allowed to gravity drain or discharge to a sump pit inside the building. In contrast, the foundation 100 includes a sump pit 150 exterior to the walls 118 to receive collected drainage or groundwater near the slab 110 while avoiding the creation of an opening in the slab 110. The sump pit 150 is shown to be formed of concrete but other materials, such as plastic, may be used for the side walls and floor of sump pit 150. A pump 152 is placed in the bottom of the pit 150 for pumping collected water through the sump drain line 154 for discharging the pit water at a point a distance away from the walls 118 and slab 110. The sump pit 150 is located in a window well 140 such that ready access may be gained to the sump pit 150 and contained pump 152. However, in some embodiments, it may be useful to place the sump pit 150 in a different location not in a window well 140 and in these embodiments, a separate access is provided to the sump pit 150.

The window well 140 of the foundation 100 also is included to provide access to the void space below the slab 110 and walls 118. In this regard, the window well 140 includes a ladder 144 and is provided to a depth below grade that places the bottom of the well 140 at about the top surface of the soil 126 or the bottom of the dam 130. The dam 130 is configured such that a removable section of the dam 130 is positioned fully within the window well 140. Upon the removal of pins 132 and 136 from the window well section of the dam 130, the section can be moved to provide access to the void space under the slab 110 and walls 118.

Figure 2:
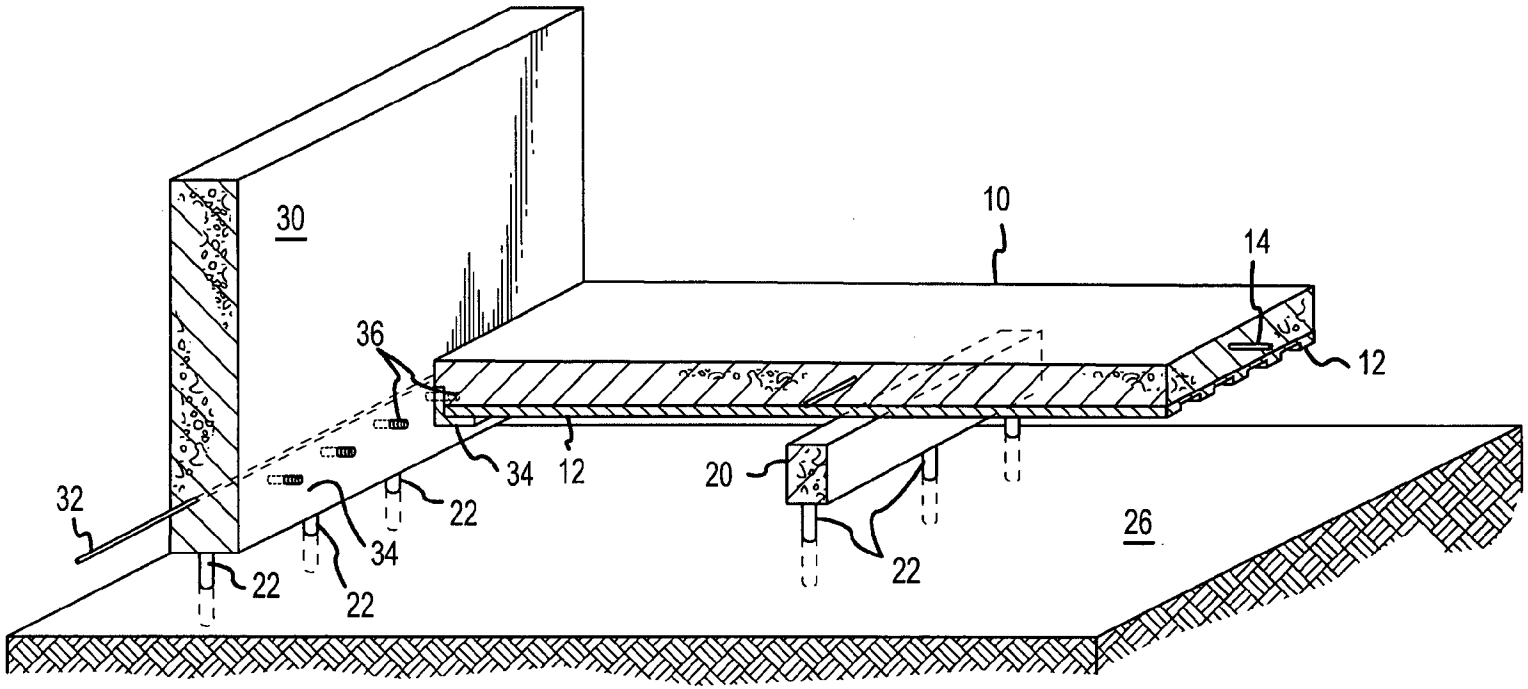
FIG. 2 is a perspective view of a structural slab and foundation wall assembly that may be utilized with the external sump pit, window well access, and/or dam of the present invention, such as shown in FIG. 1, and is shown to utilize a concrete support beam to support a slab to create voids between the soil and the slab but to use a wall-supported slab.

As will be appreciated, the foundation ideas of the present invention are not limited to the slab and wall assembly shown in FIG. 1 (e.g., the combination of slab 110, wall 118, and associated components) as the dam 130 and sump pit 150 location may be used with other slab and wall arrangements. In this regard, one embodiment of a foundation wall and structural slab assembly that may be used in place of the wall 118 and slab 110 assembly is shown in FIG. 2. As shown, a structural slab 10 is provided that is supported by a structural beam 20 above the soil or excavation floor 26 to create a void space between the slab 10 and the soil 26, which may expand and contract. Significantly, the structural beam 20 eliminates the need for degradable wood or steel beams and/or void boxes while still providing adequate structural support for the slab during initial pouring or formation activities and during the ongoing use of the slab 10. The slab 10 is typically formed using concrete that is poured into form 12, which may be a metal pan with or without channels or ribs that provide additional strength as shown in FIG. 2. For additional strength and integrity, the slab 10 may include steel bars 14, which may also be used to connect the structural slab 10 to the foundation wall 30 in conventional fashion.

The support beam 20 is also preferably formed of materials that are not readily degradable (such as cardboard void boxes) and that are not problematic in damp conditions (such as untreated steel which may rust and become weakened). In one preferred embodiment, the structural beam 20 is formed of concrete. The beam 20 may be intermittent, e.g., have gaps, or as shown may be a continuous beam that extends that length of the slab 10 (or alternatively, may be a continuous beam that extends for at least a substantial portion of the inner portion of the slab 10). The specific shape and dimensions of the beam 20 may also be varied to practice the invention. For example, in some embodiments, the beam 20 is rectangular (such as 10 by 24 inches or other useful sizes) and in other embodiments, the beam 20 is square (such as 4 by 4 inches or other useful sizes). The dimensions and shapes of the beam are preferably selected to limit the amount of materials required for the beam 20 while providing adequate support strengths for the beam 20 to support the slab 10.

Although one beam 20 is shown in FIG. 1, multiple beams 20 may be used to support the slab 10. For example, it is typically preferably (or even necessary) that the unsupported length (i.e., span distance) of pan 12 and slab 10 between the wall 30 and beam 20 and/or between adjacent beams 20 (not shown) be kept below a predetermined maximum span distance to provide desired pan 12 and slab support. This maximum span distance, of course, will vary with the shape and materials used for the pan or form 12 and the weight of the concrete used in the slab 10. In smaller slabs 10, no beam or one beam 20 located centrally between side foundation walls 30 may be adequate to support the slab 10 and pan 12 while in larger slabs 10 the use of 2 or more beams 20 with relative equal spacing may be more desirable. The number and spacing of such beams 20 may also vary based on the slab loading or weight rating desired for the slab 10.

The support beam 20 may be positioned on piers 22 (or in some cases footing pads and helical screws and the like (not shown) may be used) that extend into the soil 26 and are typically formed from concrete. In some embodiments, the beam 20 and piers 22 are formed in a single concrete pour or in a monolithic fashion. In more typical embodiments, the piers 22 are formed prior to the placing of the beam 20 with the beams being formed upon the piers 22 (or formed elsewhere and mated to the piers 22 such as with metal beam supports formed in the piers 22 (not shown)).

Figure 3:
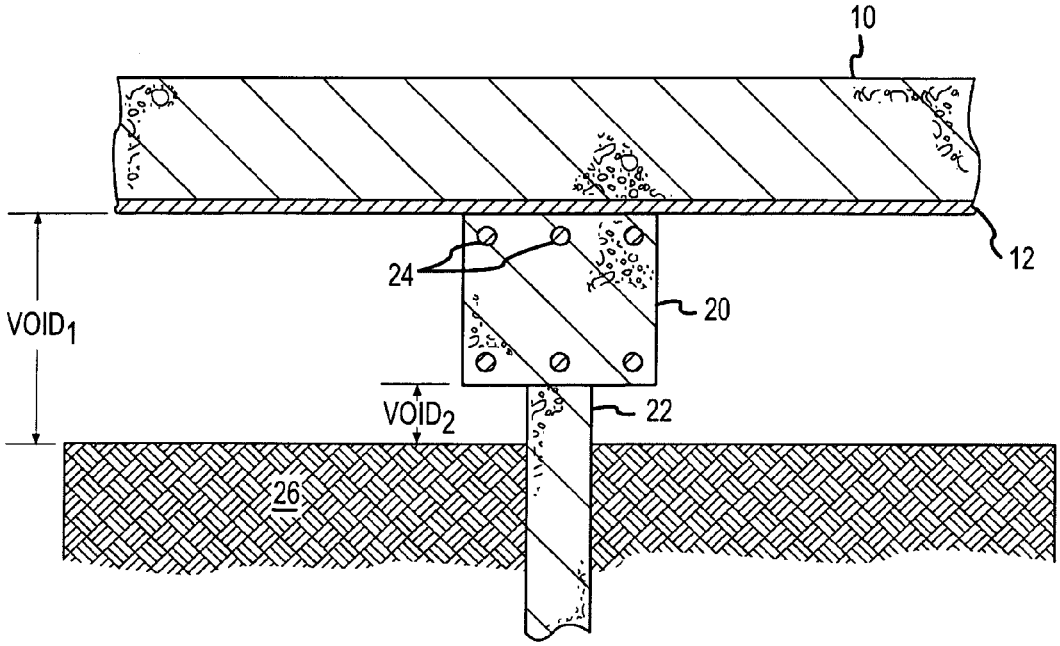
FIG. 3 is a more detailed, cross-sectional view of the slab and support beam of FIG. 2 showing the use of a pier to support the beam which, in turn, supports a form pan and the slab in the pan.

As shown in FIG. 3, the beam 20 contacts the pan or form 12 to support the slab 10 and, importantly, to provide a void or expansion space between the slab 10 and the soil 26. In the embodiment shown, a first void is provided (as shown with the arrow labeled, $Void_1$) between the slab 10 (and more specifically, between the pan 12) and the soil 26. The size of the first void or the first void distance, $Void_1$, as measured from the top of the soil 26 to the bottom of the pan 12 is initially at least as large as the side dimension of the beam 20 (except in embodiments in which the beam 20 is placed in a trench) and is, typically, selected to be larger than anticipated expansion of the soil 26 and can vary significantly based on the composition of the soil 26 and geographically specific factors (such as moisture content in the soil 26, ground temperature variations and ranges, and the like). Although not necessary to practice the invention, the illustrated slab assembly of FIG. 2 further includes a space or void having a void distance, $Void_2$, between the bottom of the beam 20 and the soil 26. The second void is useful for initially placing the beam 22 on the piers 22 and provides added protection against the expansive soil 26. To increase the strength and structural integrity of the beam 20, steel, fiberglass, or metal bars 24 can be included with a number, size, and location well known in the construction arts.

Referring again to FIG. 2, the foundation wall and slab assembly includes a foundation wall 30 supported on piers 22 with a void space between the bottom of the wall 30 and soil or excavated floor 26. The wall 30 is not a required feature for practicing the slab assembly features of the invention. The wall 30 is typically formed onsite or in situ by pouring a hardenable material such as concrete into a form (not shown in FIG. 2) and allowing the material to set and bond to the piers 22. Metal bars 32 can be provided for added strength. The wall 30 further acts to structurally support an end of the slab 10. This end support can be provided as shown with a support member 34 (such as one or more segments of angle iron or other metal or corrosion resistant material such as galvanized steel or plastic) that is attached with studs or bolts 36 drilled or otherwise attached to wall 30. The support members 34 are used to support the ends of forms 12 before and after pouring of slab 10. In this arrangement, the slab 10 and wall 30 are generally formed or poured separately. In other embodiments where the slab 10 is formed in a second pour, spaced-apart dowels are used to provide support for center grade beam 20. The dowels are formed of bent rebar (sometimes called Z-bar) and are positioned with one end extending into the wall 30 and another extending into the later poured beam 20, with the end in the beam 20 being lower than the portion in the wall 30.

Figure 4:
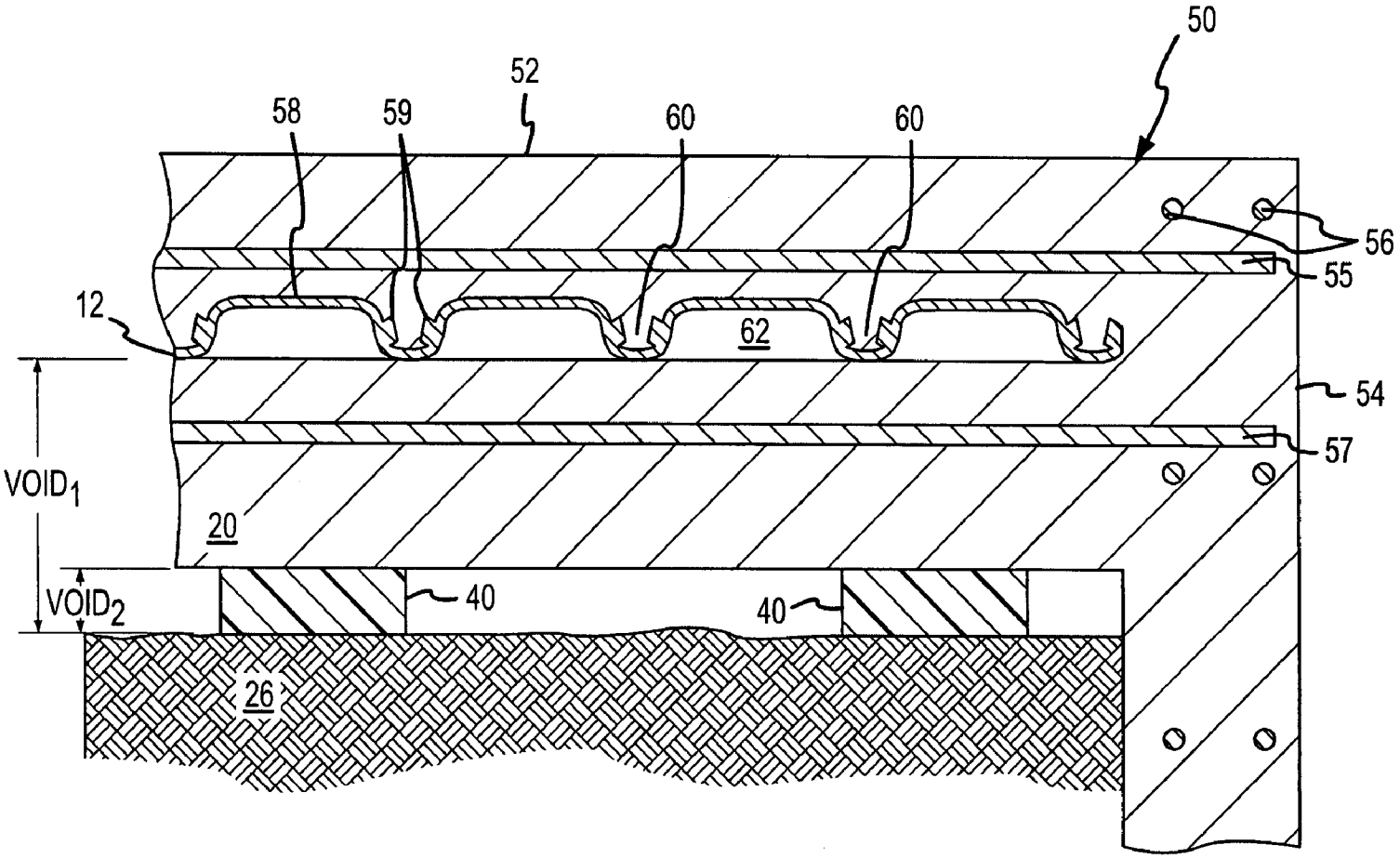
FIG. 4 is a cross-sectional view of another embodiment of a slab and foundation assembly similar to the assembly of FIG. 2 that can be used in the foundation of the present invention showing the use of a channeled pan and a monolithic slab and foundation wall.

FIG. 4 is an end, sectional view of another foundation wall and structural slab assembly 50 similar to that shown in FIG. 2 better illustrating the forming pan 12 and utilizing a monolithic pour to form the slab 52 and the wall 54. Additionally, the assembly 50 utilizes footing pads 40 (or piers 22 as shown in FIGS. 1 and 2) to support one or more support beams 20. As shown, the assembly 50 includes a foundation or side wall 54 with structural rods or bars 56 and extending vertically and extending into the soil 26 (or being spaced apart from the soil with void spaces as shown in FIGS. 1 and 2) and typically supported by piers (not shown).

The sidewall 54 is bonded to (or continuously formed with) horizontally extending and planar slab 52. The slab 52 has a relatively smooth, planar upper surface but has a ribbed or channeled bottom surface for added structural strength with reduced material requirements. This is achieved using ribbed or channel forming pan 12 which has channels 58 defining air spaces or voids and, more importantly, ribs 60 that extend outward from the slab 52 and extend in a series of parallel, elongated ridges or ribs along the lower surface of the slab 52. The pan 12 further includes numerous, spaced-apart tags 59 which extend outward from sides of the channels 58 along the length of the channels 58 to protrude into the ribs 60 and "bond" the pan 12 to the slab 52 (e.g., minimize movement of the pan 12 relative to the ribs 60 especially as measured along the length of the ribs 60). A number of other form cross-sectional shapes, with or without channels 58 and/or tags 59 may be used to practice the invention and when channels 58 are provided the depth and number or density of such channels can also be varied significantly. Further, the material and pan thickness or gauge may be selected from a range of materials and material thickness readily available in the construction industry.

As shown in FIG. 3, the support beam 20 contacts the pan 12 to provide support for the slab 52 and to create a void between the slab 52 and the expanding soil 26. The void space is defined by a first void distance, $Void_1$, which is preferably initially (i.e., at initial installation of the assembly 50) at least as large as the side dimension of the beam 20 and is measured between the bottom of the pan 12 and the top of the soil or excavation floor 26. A second void space as defined by void distance, $Void_2$, is provided between the bottom of the beam 20 and the top surface of the soil 26. In other embodiments not shown, the beam 20 may be structurally attached to the wall 54 or even monolithically formed with the wall 54 and the slab 52 (or just with the wall such as in embodiments similar to that shown in FIGS. 1 and 2 where the wall and slab are formed as separate elements).

The above disclosure sets forth a number of embodiments of the present invention. Other arrangements or embodiments, not precisely set forth, could be practiced under the teachings of the present invention and as set forth in the following claims.

I claim:

1. A structural foundation for use in expansive or other soil, comprising:

a plurality of structural support members extending from the soil a void distance;

a slab form for receiving hardenable material positioned to extend horizontally and supported by the support members;

a structural slab of the hardenable material cast into the slab form;

a wall formed of hardenable material extending substantially vertically from an upper surface of the slab, whereby the wall is supported by the slab;

a dam assembly comprising a plurality of barrier elements positioned adjacent the periphery of the slab in contact with the soil and the slab; and a window well abutting the slab and the wall, wherein at least one of the barrier elements is positioned in the window well and is anchored to the soil with removable anchors.

2. The foundation of claim 1, further including a connector extending into the slab and into the wall to mechanically join the slab and wall.

3. The foundation of claim 1, further including an end beam formed monolithically with the slab, the end beam being positioned on a surface of the slab opposite the wall and abutting at least some of the structural support members.

4. The foundation of claim 3, wherein the end beam has a width of about a width of the wall.

5. The foundation of claim 1, further including an elongate support beam positioned between and in abutting contact with a bottom surface of the slab form and at least a portion of the structural support members.

6. The foundation of claim 1, further including a sump pit connected to a discharge of a drainage element and located in the soil outside of an envelope defined by the slab.

7. A foundation for use in soil, comprising:

a slab and wall assembly including a horizontally extending slab of concrete and a concrete wall extending vertically from the slab and attached to the slab;

a plurality of support members embedded in the soil and contacting the slab and wall assembly to vertically support the slab and wall assembly, wherein a void space is defined between the slab and wall assembly and soil beneath the slab and wall assembly; and a dam including a plurality of planar members positioned in abutting contact with adjacent ones of the planar members, with the soil beneath the slab and wall assembly, and with a lower portion of the slab and wall assembly, wherein the planar members extend about the periphery of the slab and wall assembly and downward from the slab and wall assembly to the abutted soil beneath the slab and wall assembly.

8. The foundation of claim 7, wherein the wall is positioned upon an upper surface of the slab to be supported by the slab.

9. The foundation of claim 8, wherein the slab includes an end beam extending from a lower surface of the stab opposite the position of the wall and extending about the periphery of the slab in contact with a subset of the support members.

10. The foundation of claim 7, further including a sump pit positioned adjacent to an exterior surface of the dam.

11. The foundation of claim 7, further including a window well extending into the soil adjacent the slab and wall assembly, wherein the window well has a depth and width to expose at least one of the planar members and wherein the at least one is anchored to the soil with removable anchors.

12. A foundation for use in soil, comprising:

a slab and wall assembly including a horizontally extending slab of concrete and a concrete wall extending vertically from the slab and attached to the slab;

a plurality of support members embedded in the soil and contacting the slab and wall assembly to vertically support the slab and wall assembly, wherein a void space is defined between the slab and wail assembly and the soil;

a sump pit positioned adjacent the slab and wall assembly exterior to the periphery of the wall, the sump pit being connected to drainage pipes to collect water discharged from the pipes; and a well with a wall defining a hole in the soil immediately adjacent slab and wall assembly over the sump pit, whereby the window well hole exposes a portion of the concrete wall and the slab of the slab and wall assembly and provides access to the sump pit.

13. The foundation of claim 12, further including a dam extending about a periphery of the slab and wall assembly and positioned in abutting contact with the soil and the slab and wall assembly.

14. The foundation of claim 12, wherein the wall is positioned on top of the slab such that the slab is between the wall and the support members.

15. The foundation of claim 14, further including an elongate, concrete support beam positioned on a number of the support members to abut a lower surface of the slab.

16. The foundation of claim 15, the slab and wall assembly further including a slab form supporting the lower surface, the lower surface comprising a series of ridges and the slab form abutting the support beam.

17. The foundation of claim 16, wherein the slab and wall assembly further includes a concrete end support beam positioned between the slab and a number of the support members to abut a portion of the lower surface of the slab opposite the wall.

* * * * *